US010545000B2

(12) United States Patent
Farlow

(10) Patent No.: US 10,545,000 B2
(45) Date of Patent: Jan. 28, 2020

(54) REINFORCING CLIP AND HEAT EXCHANGER

(71) Applicants: DENSO International America, Inc., Southfield, MI (US); DENSO CORPORATION, Kariya, Aichi-pref. (JP)

(72) Inventor: Parker Farlow, Warren, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 296 days.

(21) Appl. No.: 15/459,318

(22) Filed: Mar. 15, 2017

(65) Prior Publication Data

US 2018/0266775 A1 Sep. 20, 2018

(51) Int. Cl.

| | |
|---|---|
| ***F28F 19/00*** | (2006.01) |
| ***F28F 9/013*** | (2006.01) |
| ***F28D 1/053*** | (2006.01) |
| ***F28F 1/12*** | (2006.01) |
| *F28D 1/02* | (2006.01) |

(52) U.S. Cl.

CPC ..... *F28F 9/0131* (2013.01); *F28D 1/05366* (2013.01); *F28F 1/126* (2013.01); *F28D 2001/028* (2013.01); *F28F 2225/06* (2013.01)

(58) Field of Classification Search

CPC . F28F 9/0131; F28F 2225/06; F28D 1/05366; F28D 2001/028

USPC ..... 165/906, 134.1

See application file for complete search history.

(56) References Cited

U.S. PATENT DOCUMENTS

| | | | | |
|---|---|---|---|---|
| 2,229,207 A | | 1/1941 | Severt | |
| 3,012,761 A | * | 12/1961 | Gardner | F28F 9/0138 165/162 |
| 4,570,704 A | * | 2/1986 | Braun | F28F 1/126 165/162 |
| 4,719,967 A | | 1/1988 | Scarselletta | |
| 5,404,940 A | | 4/1995 | van den Nieuwenhuizen et al. | |
| 5,535,819 A | | 7/1996 | Matsuura | |
| 6,357,513 B1 | * | 3/2002 | Janezich | F28F 1/02 122/510 |
| 6,533,027 B2 | * | 3/2003 | Gille | F28D 1/0435 165/140 |

(Continued)

FOREIGN PATENT DOCUMENTS

| | | | | |
|---|---|---|---|---|
| CN | 203704753 U | | 7/2014 | |
| DE | 102014212085 A1 | * | 12/2015 | D06F 58/24 |

(Continued)

*Primary Examiner* — Paul Alvare

(57) ABSTRACT

The present disclosure provides a reinforcing clip for a heat exchanger. The reinforcing clip includes a first supporter, a second supporter, and a connecting member. Each of the first supporter and the second supporter includes a first support element and a second support element. The connecting member connects the first support element to the second element while separating the first support element away from the second support element in the vertical direction. The first support element is in contact with the first fin and the one side of the tube when the first support element is inserted into the space between the first fin and the tube. The second support element is in contact with the second fin and the other side of the tube when the second support element is inserted into the space between the second fin and the tube.

12 Claims, 5 Drawing Sheets

(56) References Cited

U.S. PATENT DOCUMENTS

| | | | | |
|---|---|---|---|---|
| 6,901,992 | B2 * | 6/2005 | Kent | F28F 9/002 165/67 |
| 6,932,152 | B2 | 8/2005 | Iwasaki et al. | |
| 7,007,745 | B2 | 3/2006 | Iwasaki et al. | |
| 7,017,656 | B2 | 3/2006 | Beddome et al. | |
| 7,152,668 | B2 | 12/2006 | Hoffman et al. | |
| 7,234,511 | B1 * | 6/2007 | Lesage | B21D 53/085 165/69 |
| 7,461,689 | B2 | 12/2008 | Merklein et al. | |
| 7,487,589 | B2 | 2/2009 | Smith et al. | |
| 8,020,524 | B2 | 9/2011 | Miyagawa | |
| 8,656,988 | B1 | 2/2014 | Paul et al. | |
| 8,999,083 | B2 | 4/2015 | Suzuki et al. | |
| 2001/0040021 | A1 * | 11/2001 | Avequin | F28D 1/0435 165/67 |
| 2003/0131976 | A1 | 7/2003 | Krause et al. | |
| 2011/0073277 | A1 * | 3/2011 | Karl | F24F 13/30 165/67 |
| 2013/0206377 | A1 | 8/2013 | Ikoma | |
| 2015/0300757 | A1 | 10/2015 | Yang | |
| 2018/0266775 | A1 * | 9/2018 | Farlow | F28F 9/0131 |

FOREIGN PATENT DOCUMENTS

| | | | | | |
|---|---|---|---|---|---|
| JP | 10288478 | A | * | 10/1998 | F28D 9/0037 |
| JP | 2006078091 | A | * | 3/2006 | F28D 9/0037 |
| JP | 2007078214 | A | * | 3/2007 | F28D 1/05366 |
| JP | 2016133256 | A | * | 7/2016 | F28F 9/00 |
| WO | 2015163808 | A1 | | 10/2015 | |

* cited by examiner

REINFORCING CLIP AND HEAT EXCHANGER

TECHNICAL FIELD

The present disclosure relates to reinforcing clip for a heat exchanger and a heat exchanger having the reinforcing clip.

BACKGROUND

A heat exchanger includes a core having a plurality of tubes and a plurality of fins that are stacked with one another. The core is formed by brazing the fins and the tubes to each other. To enhance heat releasing performance, fins are typically formed from thin metal, and therefore the fins may be easily damaged. For example, during operation of the heat exchanger, tubes may expand due to heat expansion characteristics. Therefore, the fins receive stresses arising from the heat expansion, which may cause the fins to be damaged.

SUMMARY

This section provides a general summary of the disclosure, and is not a comprehensive disclosure of its full scope or all of its features.

An aspect of the present disclosure provides a reinforcing clip for a heat exchanger. The reinforcing clip includes a first support element, a second support element, and a connecting member. The first support element is inserted into a space formed between a first fin and a tube. The first fin is adjacent to the tube, in a direction, on one side of the tube. The second support element is inserted into a space formed between a second fin and the tube. The second fin is adjacent to the tube, in the direction, on an other side of the tube that is opposite to the one side of the tube. The connecting member connects the first support element to the second support element while separating the first support element away from the second support element in the direction. The first support element is in contact with the first fin and the one side of the tube when the first support element is inserted into the space between the first fin and the tube. The second support element is in contact with the second fin and the other side of the tube when the second support element is inserted into the space between the second fin and the tube.

A second aspect of the present disclosure provides a reinforcing clip for a heat exchanger. The reinforcing clip includes a first supporter, a second supporter, and a connecting member. The connecting member connects the first supporter to the second supporter while separating the first supporter away from the second supporter in a first direction. Each of the first supporter and the second supporter includes a first support element and a second support element. The first support element is inserted into a space formed between a first fin and a tube. The first fin is adjacent to the tube, in a second direction, on one side of the tube. The second support element is inserted into a space formed between a second fin and the tube, the second fin being adjacent to the tube, in the second direction, on an other side of the tube that is opposite to the one side of the tube. The connecting member connects the first support element to the second element while separating the first support element away from the second support element in the second direction. The first support element is in contact with the first fin and the one side of the tube when the first support element is inserted into the space between the first fin and the tube. The second support element is in contact with the second fin and the other side of the tube when the second support element is inserted into the space between the second fin and the tube.

A third aspect of the present disclosure provides a heat exchanger including a plurality of fins and a plurality of tubes, and a reinforcing clip. The plurality of fins and a plurality of tubes extend along a first direction and alternately are stacked with each other in a second direction to form a core. The reinforcing clip is attached to the core. The plurality of tubes include a particular tube. The plurality of fins include a first fin and a second fin. The first fin is adjacent to the particular tube on one side of the particular tube to form a space between the first fin and the one side of the particular tube. The second fin is adjacent to the particular tube on an other side of the particular tube, which is opposite to the one side of the particular tube, to form a space between the second fin and the other side of the particular tube. The reinforcing clip includes a first support element, a second support element, and a connecting member. The first support element is in contact with the first fin and the one side of the particular tube when inserted into the space between the first fin and the particular tube. The second support element is in contact with the second fin and the other side of the particular tube when inserted into the space between the second fin and the particular tube. The connecting member connects the first support element to the second support element while separating the first support element away from the second support element in the second direction.

A fourth aspect of the present disclosure provides a heat exchanger including a plurality of fins, a plurality of tubes, and a reinforcing clip. The plurality of fines and the plurality of tubes extend along a first direction and are alternately stacked with each other in a second direction to form a core. The reinforcing clip is attached to the core. The plurality of tubes include a particular tube. The plurality of fins include a first fin and a second fin. The first fin is adjacent to the particular tube on one side of the particular tube to form a space between the first fin and the one side of the particular tube. The second fin is adjacent to the particular tube on an other side of the particular tube, which is opposite to the one side of the particular tube, to form a space between the second fin and the other side of the particular tube. The reinforcing clip includes a first supporter, a second supporter, and a connecting member. The connecting member connects the first supporter to the second supporter while separating the first supporter away from the second supporter in the first direction. Each of the first supporter and the second supporter includes a first support element and a second support element. The first support element is in contact with the first fin and the one side of the particular tube when inserted into the space between the first fin and the particular tube. The second support element is in contact with the second fin and the other side of the particular tube when inserted into the space between the second fin and the particular tube. The connecting member connects the first support element to the second support element while separating the first support element away from the second support element in the second direction.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure. In the drawings.

DETAILED DESCRIPTION

Figure 1:
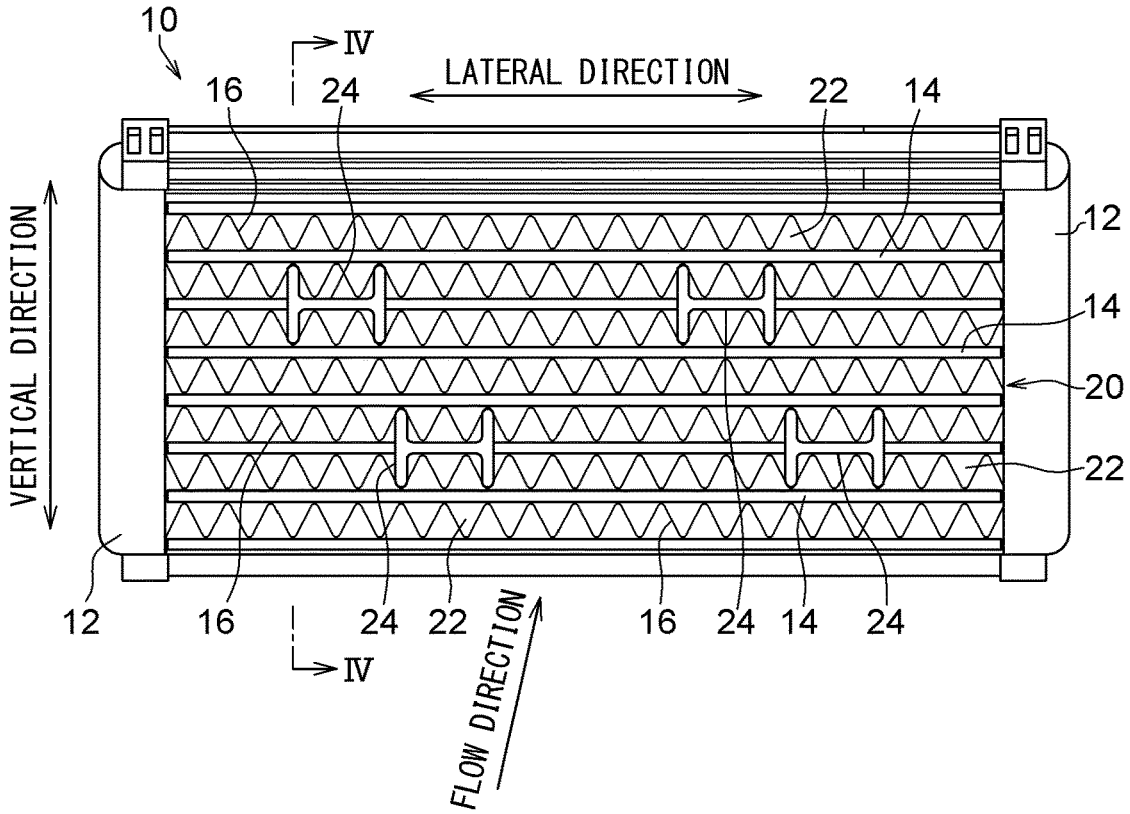
FIG. 1 is a front view of a radiator according to a first embodiment.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

First Embodiment

FIG. 1 illustrates a radiator 10 which serves as a heat exchanger for a vehicle (not shown) according to the first embodiment. The radiator 10 is installed in an engine compartment at a front side and receives an outside air while the vehicle is traveling. The radiator 10 includes two side tanks 12, a plurality of tubes 14, and a plurality of fins 16. The tubes 14 and the fins 16 are integrated with each other and brazed into one component. Then, the side tanks 12 are integrated with the brazed tubes and fins. The radiator 10 serves as a portion of a cooling circuit (not shown) through which a thermal medium, such as an engine coolant, circulates.

The tubes 14 extend along a lateral direction, or a first direction, to be parallel with each other, and the thermal medium flows through the tubes 14. The tube 14 has an elongated shape in the lateral direction and is formed of two flat surfaces 14*a* and two curved surfaces 14*b* (see FIG. 4). The two flat surfaces 14*a* (one side and the other side of the tube 14) are opposite to each other in a vertical direction, or a second direction, which is perpendicular to the lateral direction. The two curved surfaces 14*b* (portions of the tube 14) are opposite to each other in a flow direction, or a third direction, which is perpendicular to both the lateral direction and the vertical direction.

Figure 2:
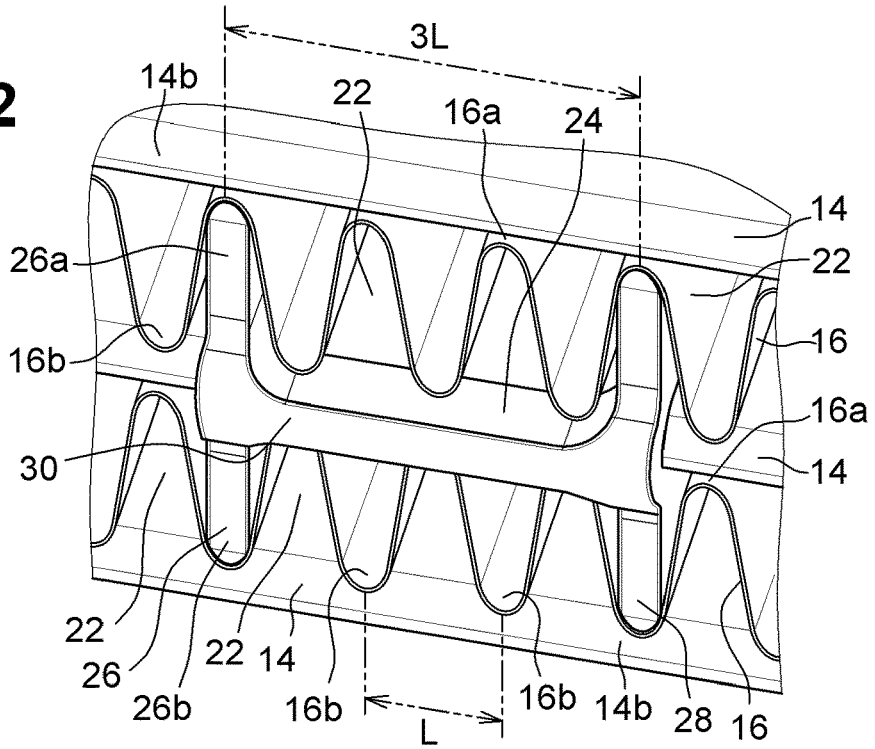
FIG. 2 is an enlarged perspective view of the radiator.

Each of the fins 16 is made from a thin metal and is formed in a wave form. The fins 16 extend in the lateral direction to be parallel with each other. More specifically, the fin 16 includes a plurality of apexes 16*a* and a plurality of bottoms 16*b* that are arranged alternately along the lateral direction. As shown in FIG. 2, the distance between the two adjacent apexes 16*a* in the lateral direction is the same as others. Similarly, the distance between the two adjacent bottoms 16*b* is the same as others (indicated as "L" in FIG. 2). Furthermore, as for the two adjacent fins 16 in the vertical direction, the apexes 16*a* of the lower fin 16 are aligned with the bottoms 16*b* of the upper fin 16 in the vertical direction.

The tubes 14 and the fins 16 are stacked alternately along the vertical direction and form a core 20 of the radiator 10. The core 20 has a front side facing the front side of the vehicle and a rear side facing the rear side of the vehicle in a state where the radiator 10 is installed in the vehicle. FIG. 1 shows the front side of the core 20, which receives an outside air. A plurality of air passages 22 are defined between each of the fins 16 and the adjacent tubes 14, and air flows through these air passages 22 in the flow direction. More specifically, the air passages 22 are defined between the apexes 16*a* and the tubes 14 and between the bottoms 16*b* and the tubes 14. For example, as for one fin 16 and two adjacent tubes 14 (the upper tube 14 and the lower tube 14), the air passages 22 are defined between the apexes 16*a* of the fin 16 and the upper flat surface (one side) 14*a* of the lower tube 14 and between the bottoms 16*b* of the fin 16 and the lower flat surface (the other side) 14*a* of the upper tube 14 (see FIG. 4). The fins 16 enhance a heat exchanging performance of the core 20 between the thermal medium, which flows through the tubes 14, and air, which passes through the air passages 22.

Figure 3:
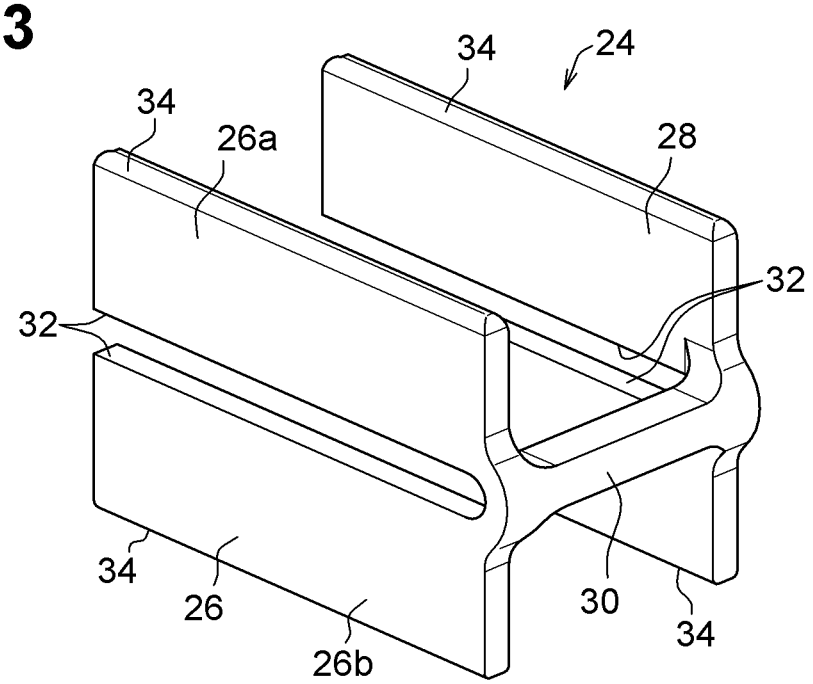
FIG. 3 is a perspective view of a reinforcing clip according to the first embodiment.

The radiator 10 further includes a plurality of reinforcing clips 24. In the present embodiment, four reinforcing clips 24 are coupled to the core 20 as show in FIG. 1, which is not necessarily limited to four and may vary depending on situations such as the size of the radiator 10. As shown in FIG. 3, each of the reinforcing clips 24 includes a first supporter 26, a second supporter 28, and a connecting member 30. The first and second supporters 26, 28 are connected to each other through the connecting member 30 with a given distance in the lateral direction. In the present embodiment, the distance between the first and second supporters 26, 28 are set to be three times of the distance between the adjacent apexes 16*a*. That is, the distance between the first and second supporters 26, 28 can be indicated as "3L" as shown in FIG. 2. Since the first supporter 26 and the second supporter 28 have substantially the same structure, the structure of the first supporter 26 will be mainly described below and description of the structure of the second supporter 28 will be omitted unless otherwise specifically described.

Figure 4:
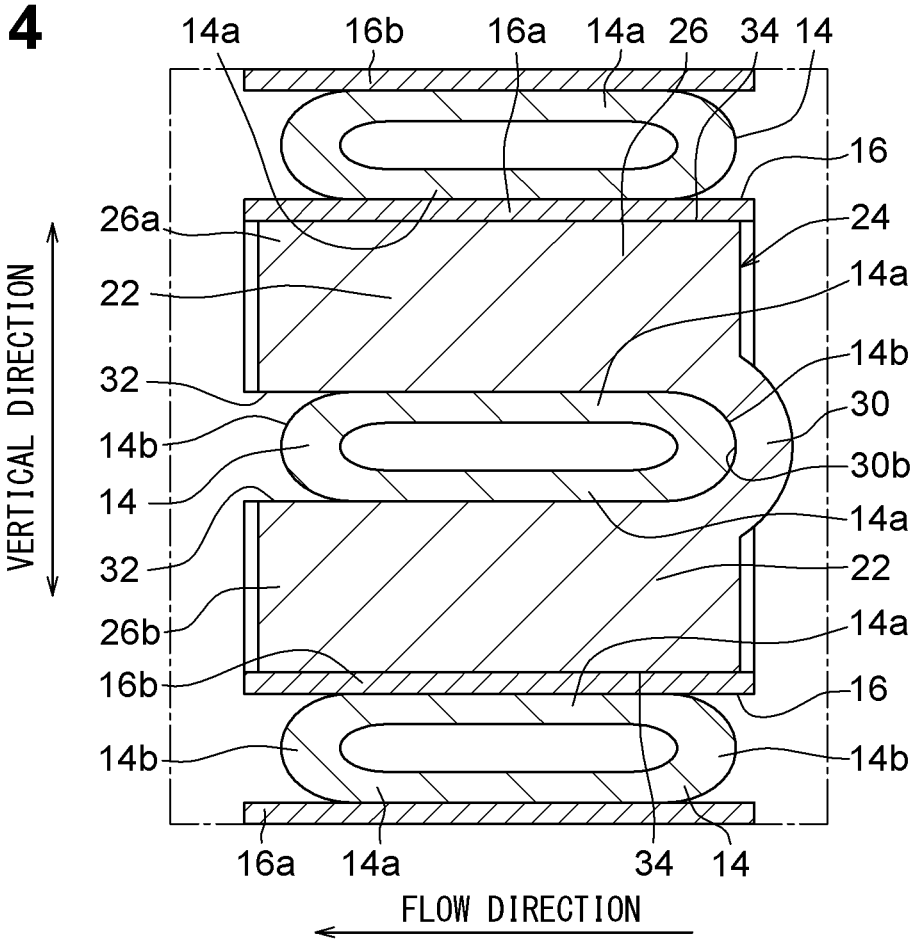
FIG. 4 is a cross-sectional view of the radiator taken along IV-IV line in FIG. 1.

The first supporter 26 includes a first support element 26*a* and a second support element 26*b*. The first support element 26*a* is positioned above the second support element 26*b* and is connected to the second support element 26*b* through the connecting member 30. In the present embodiment, the first support element 26*a* is aligned with the second support element 26*b* in the vertical direction with a given distance. As shown in FIG. 4, the given distance is substantially the same as the thickness of the tube 14 along the vertical direction (i.e., the distance between the two flat surfaces 14*a* of the tube 14).

The first support element 26*a* and the second support element 26*b* have substantially the same shape, i.e., a plate shape extending along the flow direction. The length of the first support element 26*a* along the vertical direction is substantially the same as the height of the apex 16*a* of the fin 16, i.e., the distance between the apex 16*a* of the fin 16 and the upper flat surface 14*a* of the tube 14. Thus, the first support element 26*a* can be inserted (fit) into the air passage 22 (a space). Similarly, the length of the second support element 26*b* along the vertical direction is substantially the same as the depth of the bottom 16*b* of the fin 16, i.e., the distance between the bottom 16*b* of the fin 16 and the lower flat surface 14*a* of the tube 14. Thus, the second support element 26*b* can be also inserted (fit) into the air passage (the space) 22.

As shown in FIG. 3, each of the first support element 26*a* and the second support element 26*b* includes a first contact portion 32 and a second contact portion 34 that are opposite to each other in the vertical direction. The first contact portion 32, which is close to the connecting member 30, has a flat surface, whereas the second contact portion 34, which is away from the connecting member 30, has a curved surface along the shape of the apex 16*a* of the fin 16 (or the shape of the bottom 16*b* of the fin 16). The first contact portion 32 and the second contact portion 34 of the first support element 26*a* are in contact with the upper flat surface 14*a* of the tube 14 (the one side of a particular tube) and the apex 16*a* of the fin 16 (a first fin), respectively, when the first support element 26*a* is inserted into the air passage 22. In contrast, the first contact portion 32 and the second contact portion 34 of the second support element 26*b* are in contact with the lower flat surface 14*a* of the tube 14 (the other side of the particular tube) and the bottom 16*b* of the fin 16 (a second fin), respectively, when the second support element 26*b* is inserted into the air passage 22. That is, the tube 14 (the particular tube) is interposed between the first support element 26*a* and the second support element 26*b* when the first and second support elements 26*a*, 26*b* are inserted into the air passages 22, as shown in FIG. 4.

The connecting member 30 is configured to extend the lateral direction. The connecting member 30 has a semi-cylindrical shape. The connecting member 30 has an inner surface that has a shape along the curved surface 14*b* of the tube 14 (the particular tube). Therefore, the inner surface serves as a contact surface 30*b* that is in contact with the curved surface 14*b* of the tube 14 on the front side of the core 20 when the reinforcing clip 24 is attached to the core 20. In other words, the connecting member 30 covers the curved surface 14*b* of the tube 14 when the reinforcing clip 24 is attached to the core 20.

The reinforcing clips 24 are attached to the core 20 before the fins 16 and the tubes 14 are brazed to each other. When attaching the reinforcing clip 24, the first supporter 26 and the second supporter 28 are inserted into the air passages 22 from the front side of the core 20. Then, in a state where the connecting member 30 is in contact with the curved surface 14*b*, the connecting member 30 is brazed to the tube 14. In this way, four reinforcing clips 24 are attached to the core 20 in this embodiment. By attaching the reinforcing clips 24 to the core 20, the first and second supporters 26, 28 of each of the reinforcing clips 24 hold the two adjacent fins 16 (the first and second fins) and the tube 14 (the particular tube) therebetween. Under the holding force by the reinforcing clips 24, the tubes 14 and the fins 16 are brazed to each other. Therefore, the brazing process can be easily performed under the holding force by the reinforcing clips 24.

In a state where the first support element 26*a* and the second support element 26*b* are inserted into the air passages 22, both the first and second support elements 26*a*, 26*b* support the fins 16 and the tube 14 by being in contact with the fins 16 and the tube 14. Especially, since the fins 16 are firmly held by the first and second support elements 26*a*, 26*b*, the reinforcing clip 24 can add strength to the fins 16. For example, during operation of the radiator 10, the tubes 14 may thermally expand in the vertical direction due to internal pressure by the thermal medium at a high temperature. Thus, the fins 16 may receive stresses from the tubes 14. However, the reinforcing clips 24 rigidly support the fins 16 with the first and second support elements 26*a*, 26*b* being inserted into the air passages 22, the fins 16 can be prevented from being damaged from the expansion stresses. In other words, the fins 16 obtain durability from the reinforcing clips 24, and therefore there is no need to increase the thickness (the gage) of the fins 16 so as to enhance the strength of the fins 16. As a result, it is possible to avoid increase in weight, material cost, and so on. Furthermore, since the fins 16 can be maintained their thin shapes, heat releasing performance of the fins 16 does not deteriorate.

Furthermore, the thickness of each fin 16 may be even decreased by using the reinforcing clips 24. In this case, it is possible to decrease in weight and cost for the core 20 and increase in heat releasing performance by the radiator 10 as compared to a conventional radiator.

Furthermore, each of the tubes 14 has a different thermal expansion characteristic (or a tube elongation characteristic) in the lateral direction. Therefore, stresses may arise from thermal strain differences among the tubes 14 during operation of the radiator 10. Typically, such stresses may be mainly applied to tube header junctions (not shown). However, when the tubes 14 are held by the reinforcing clips 24 as described above, such stresses can be distributed. Thus, damages to the tube header junctions can be suppressed due to the stress distributing effects by the reinforcing clips 24.

In addition to the above, the connecting members 30 cover the portion of the front sides of the tubes 14 when the reinforcing clips 24 are attached to the core 20. That is, the connecting member 30 can serve as a protector for the tube 14. Thus, even if stones or other debris enter the engine compartment during travel of the vehicle, the connecting members 30 can prevent the tubes 14 from directly being hit by the stones or other debris.

Second Embodiment

Figure 5A:
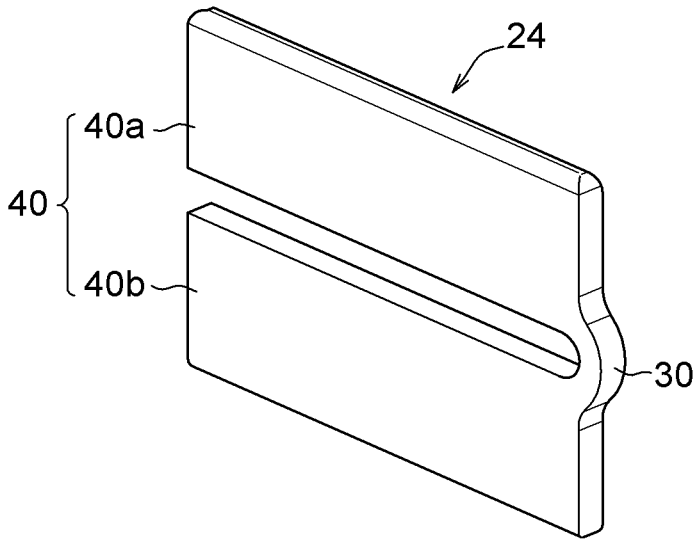
FIG. 5A is a perspective view of a reinforcing clip having one supporter according to a second embodiment.

In the first embodiment, the reinforcing clip 24 includes the first and second supporters 26, 28. Alternatively, as shown in FIG. 5A, the reinforcing clip 24 may include only one supporter 40 having the first and second support elements 40*a*, 40*b*. In this case, the connecting member 30, which does not extend in the lateral direction, connects the first support element 40*a* to the second support element 40*b* while the first support element 40*a* is away from the second support element 40*b* with a given distance.

As with the first embodiment, the reinforcing clip 24 according to the second embodiment can obtain the same advantages described above.

Figure 5B:
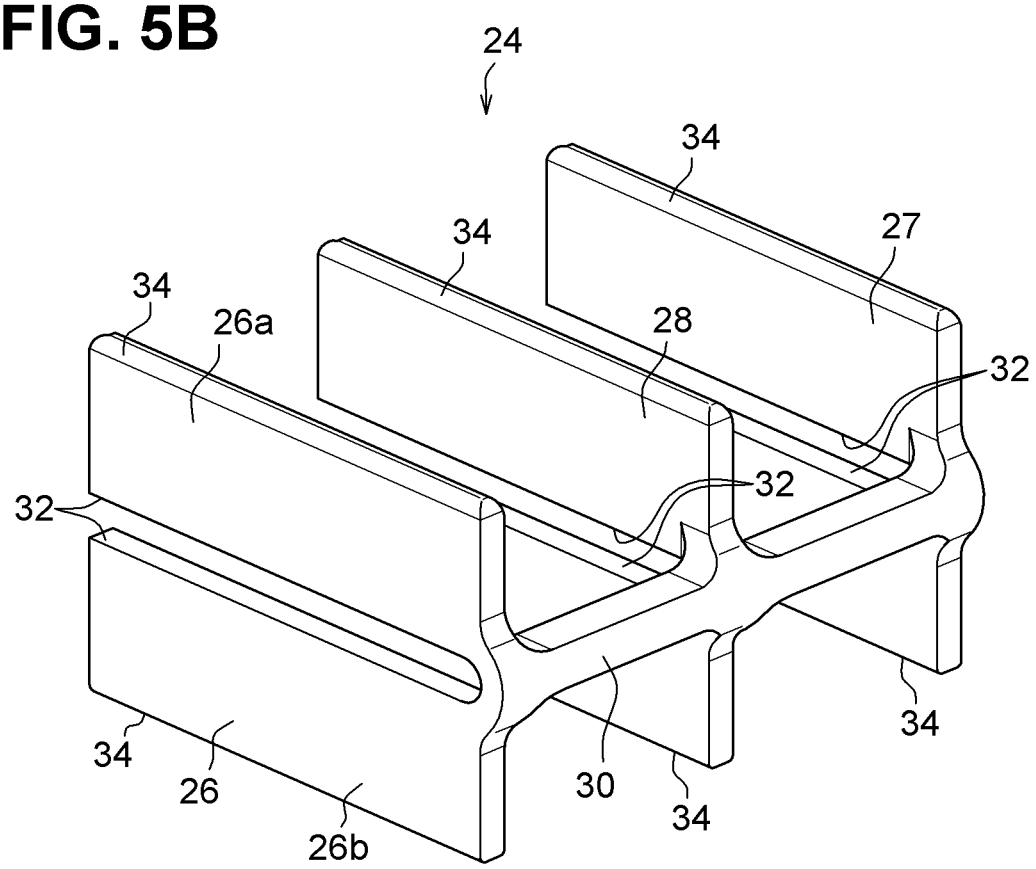
FIG. 5B is a perspective view of a reinforcing clip having three supporters according to the second embodiment.

Alternatively, the reinforcing clip 24 may include three or more supporters. For example, FIG. 5B shows the reinforcing clip 24 having three supporters 26, 28, 27.

Third Embodiment

Figure 6:
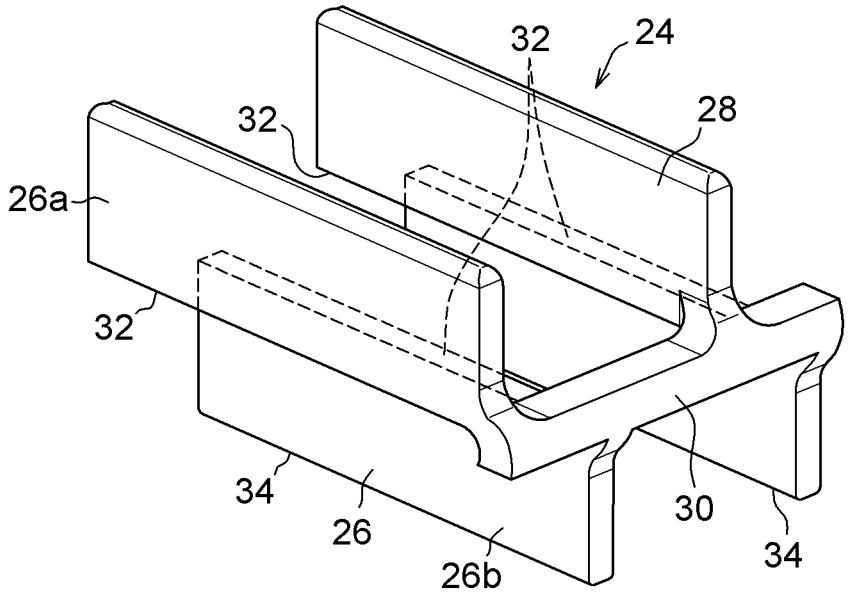
FIG. 6 is a perspective view of a reinforcing clip according to a third embodiment.
Figure 7:
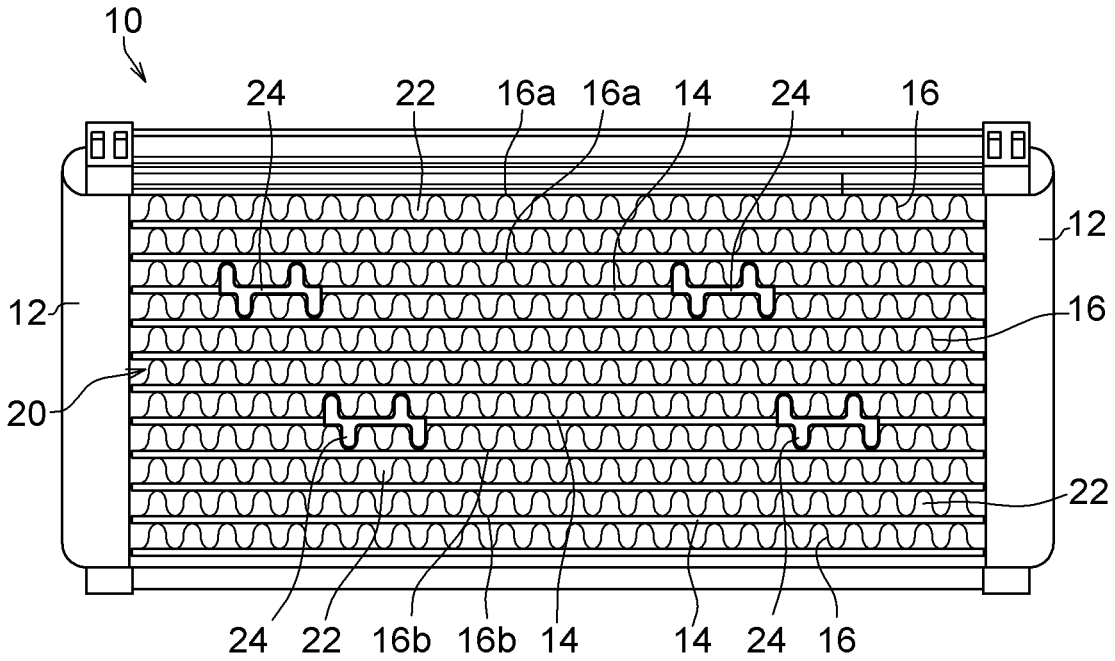
FIG. 7 is a front view of a radiator according to the third embodiment.

In the first embodiment, the first support element 26*a* is aligned with the second support element 26*b* in the vertical direction. Alternatively, the first support element 26*a* may be offset from the second support element 26*b* in the lateral direction as shown in FIGS. 6 and 7. This embodiment may be suitable for the core 20 where the apexes 16*a* (the bottoms 16*b*) of the fins 16 are aligned with each other in the vertical direction, as shown in FIG. 7.

Fourth Embodiment

Figure 8A:
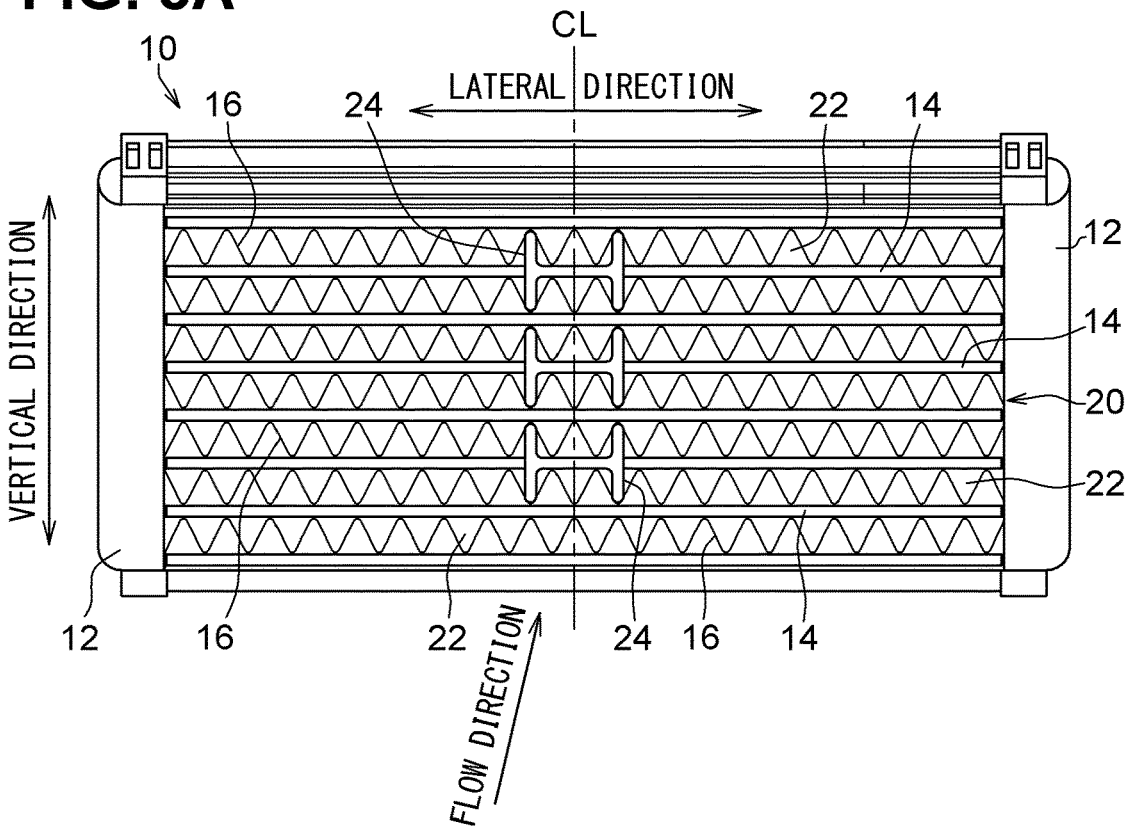
FIG. 8A is a front view of a radiator according to the fourth embodiment where reinforcing clips are arranged along a center line of a core.

The positions of the reinforcing clips 24 are not necessarily limited to those as described in the embodiments. For example, FIG. 8A shows a radiator 10 having three reinforcing clips 24. The reinforcing clips 24 are attached to the core 20 at a center position of the core 20 in the lateral direction. In other words, the reinforcing clips 24 are aligned with each other along the center line CL of the core 20. By setting the reinforcing clips 24 at the center of the core 20, the clips 24 support the center of the tubes 14 to which high stress is likely applied.

Figure 8B:
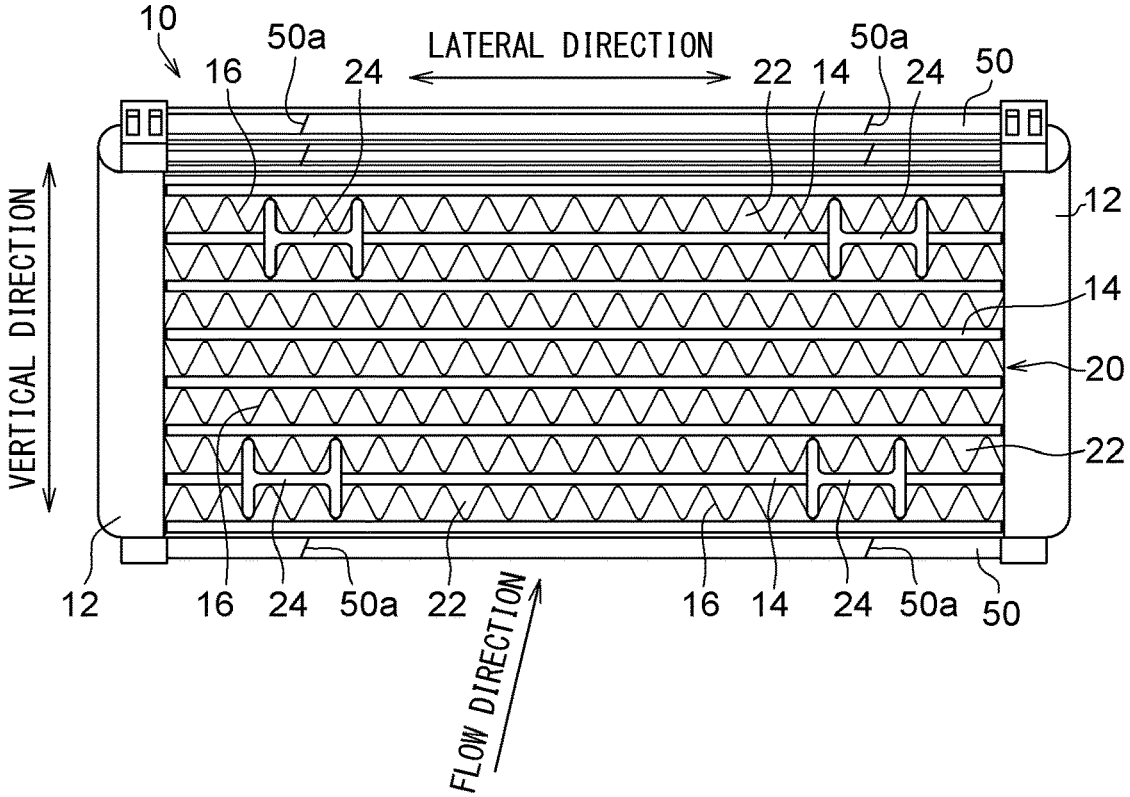
FIG. 8B is a front view of a radiator according the fourth embodiment where reinforcing clips are arranged at positions close to cuts.

Alternatively, FIG. 8B shows a radiator 10 having four reinforcing clips 24 that are disposed to close to side plates 50. The side plates 50 are arranged both an upper side end and a lower side end of the core 20. Two cuts 50*a* are formed in each of the side plates 50. Each of the reinforcing clip 24 is disposed at a location close to a respecting one of the cuts 50*a* of the side plate 50. In this case, the reinforcing clip 24 supports a portion of the tube 14 close to the cut 50*a* where the tube 14 may be easily bent as compared to other portions due to the existence of the cut 50*a*.

Other Embodiments

In the above-described embodiments, the radiator 10 is used as the heat exchanger. However, other components such as a condenser or an evaporator may be used as the heat exchanger. In the first embodiment, the distance between the first and second supporters 26, 28 along the lateral direction are set to be three times of the distance between the two adjacent apexes 16*a* (or the two adjacent bottoms 16*b*) of the fin 16. However, the distance between the first and second supporters 26, 28 may be two times of the distance between the two adjacent apexes 16*a* or four or more times of the distance between the two adjacent apexes 16*a*. Furthermore, the distance between the first and second supporters 26, 28 may be substantially the same distance between the two adjacent apexes 16*a*.

Furthermore, the reinforcing clip 24 may include a connecting member 30 having an elongated shape that continuously extends the entire length of the core 20 along the lateral direction. In this case, the elongated connecting member 30 can cover the whole length of the tube 14 in the lateral direction. Hence, the function of the connecting member 30 for protecting the tube 14 from stones/debris can be enhanced as compared to the connecting member 30 as described in the above embodiments.

Furthermore, the reinforcing clip 24 may include the first and second supporters 26, 28 each having two or more support elements that are stacked with each other in the vertical direction. The total length of the stacked support elements in the vertical direction may have substantially the same as the core 20. Since the stacked support elements hold the entire length of the core 20 in the vertical direction, the tubes 14 and the fins 16 can be brazed to each other without wire wrapping, which is conventionally required to hold the core 20 during the brazing process. As a result, it is possible to eliminate scrap wire from the wrapping process, which may lead to cost reduction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

What is claimed is:

1. A heat exchanger comprising:

a plurality of fins and a plurality of tubes, the plurality of fins and the plurality of tubes extending along a first direction and alternately being stacked with each other in a second direction to form a core; and a reinforcing clip that is attached to the core, wherein the plurality of tubes include a particular tube, the plurality of fins include a first fin and a second fin, the first fin is adjacent to the particular tube on one side of the particular tube to form a space between the first fin and the one side of the particular tube, the second fin is adjacent to the particular tube on another side of the particular tube, which is opposite to the one side of the particular tube, to form a space between the second fin and the other side of the particular tube, the reinforcing clip includes a first support element, a second support element, and an intervening portion, the first support element is in contact with the first fin and the one side of the particular tube when inserted into the space between the first fin and the particular tube, the second support element is in contact with the second fin and the other side of the particular tube when inserted into the space between the second fin and the particular tube, and the intervening portion connects the first support element to the second support element while separating the first support element away from the second support element in the second direction.

2. The heat exchanger according to claim 1, wherein the first support element and the second support element are aligned with each other in the second direction to have the particular tube interposed therebetween.

3. The heat exchanger according to claim 1, wherein the first support element and the second support element are offset from each other in the first direction.

4. The heat exchanger according to claim 1, wherein the intervening portion includes a contact surface having a shape along a portion of the particular tube, and the intervening portion covers the particular tube with the contact surface being in contact with the portion of the particular tube.

5. The heat exchanger according to claim 1, further comprising a plurality of reinforcing clips including the reinforcing clip.

6. A heat exchanger comprising:

a plurality of fins and a plurality of tubes, the plurality of fins and the plurality of tubes extending along a first direction and alternately being stacked with each other in a second direction to form a core; and a reinforcing clip that is attached to the core, wherein the plurality of tubes include a particular tube, the plurality of fins include a first fin and a second fin, the first fin is adjacent to the particular tube on one side of the particular tube to form a space between the first fin and the one side of the particular tube, the second fin is adjacent to the particular tube on another side of the particular tube, which is opposite to the one side of the particular tube, to form a space between the second fin and the other side of the particular tube, the reinforcing clip includes a first supporter, a second supporter, and an intervening portion, the intervening portion connects the first supporter to the second supporter while separating the first supporter away from the second supporter in the first direction, each of the first supporter and the second supporter includes a first support element and a second support element, the first support element is in contact with the first fin and the one side of the particular tube when inserted into the space between the first fin and the particular tube, the second support element is in contact with the second fin and the other side of the particular tube when inserted into the space between the second fin and the particular tube, and the intervening portion connects the first support element to the second support element while separating the first support element away from the second support element in the second direction.

7. The heat exchanger according to claim 6, wherein the first support element and the second support element are aligned with each other in the second direction to have the particular tube interposed therebetween.

8. The heat exchanger according to claim 6, wherein the first support element and the second support element are offset from each other in the first direction.

9. The heat exchanger according to claim 6, wherein the intervening portion includes a contact surface extending in the first direction and having a shape along a portion of the particular tube, and the intervening portion covers the particular tube with the contact surface being in contact with the portion of the particular tube.

10. The heat exchanger according to claim 6, further comprising a plurality of reinforcing clips including the reinforcing clip.

11. The heat exchanger according to claim 10, wherein the plurality of reinforcing clips are arranged in a center line of the core along the second direction.

12. The heat exchanger according to claim 10, wherein the core includes two side plates that are opposite to each other in the second direction, each of the two side plates includes a cut, and each of the plurality of reinforcing clips is arranged in the core at a position close to the cut.

* * * * *